US009849508B2

(12) United States Patent
Kohler et al.

(10) Patent No.: US 9,849,508 B2
(45) Date of Patent: Dec. 26, 2017

(54) LADLE BOTTOM AND LADLE

(71) Applicant: REFRACTORY INTELLECTUAL PROPERTY GMBH & CO. KG, Vienna (AT)

(72) Inventors: Sarah Kohler, Leoben (AT); Alexander Maranitsch, Vienna (AT); Kerry Servos, Dundas (CA)

(73) Assignee: REFRACTORY INTELLECTUAL PROPERTY GMBH & CO. KG, Vienna (AT)

( * ) Notice: Subject to any disclaimer, the term of this patent is extended or adjusted under 35 U.S.C. 154(b) by 189 days.

(21) Appl. No.: 14/769,712

(22) PCT Filed: Mar. 14, 2014

(86) PCT No.: PCT/EP2014/055083
§ 371 (c)(1),
(2) Date: Oct. 13, 2015

(87) PCT Pub. No.: WO2014/173583
PCT Pub. Date: Oct. 30, 2014

(65) Prior Publication Data

US 2016/0031008 A1 Feb. 4, 2016

(30) Foreign Application Priority Data

Apr. 26, 2013 (EP) ..... 13165484

(51) Int. Cl.
*B22D 41/08* (2006.01)
*F27B 14/08* (2006.01)
*F27D 1/00* (2006.01)
*F27D 3/15* (2006.01)
*C21C 7/00* (2006.01)

(52) U.S. Cl.
CPC ..... *B22D 41/08* (2013.01); *F27B 14/08* (2013.01); *F27D 1/0006* (2013.01);
(Continued)

(58) Field of Classification Search
CPC .... B22F 2999/00; B22F 9/24; B22F 2202/11; B22F 1/0018; B22F 1/0062; B22F 1/02;
(Continued)

(56) References Cited

U.S. PATENT DOCUMENTS 4,746,102 A * 5/1988 Gilles ..... B22D 41/08 266/236
4,776,570 A * 10/1988 Vo Thanh ..... B22D 41/003 266/229

(Continued)

FOREIGN PATENT DOCUMENTS

EP 0887131 A1 12/1998
WO 2013043257 A1 3/2013

OTHER PUBLICATIONS

International Search Report for App. No. PCT/EP2014/055083 dated Jul. 1, 2014.

*Primary Examiner* — Scott Kastler
*Assistant Examiner* — Michael Aboagye
(74) *Attorney, Agent, or Firm* — Medley, Behrens & Lewis, LLC

(57) ABSTRACT

A ladle bottom being part of a metallurgical ladle for treating a metal melt as well as a corresponding metallurgical ladle.

13 Claims, 3 Drawing Sheets

Figure 1:
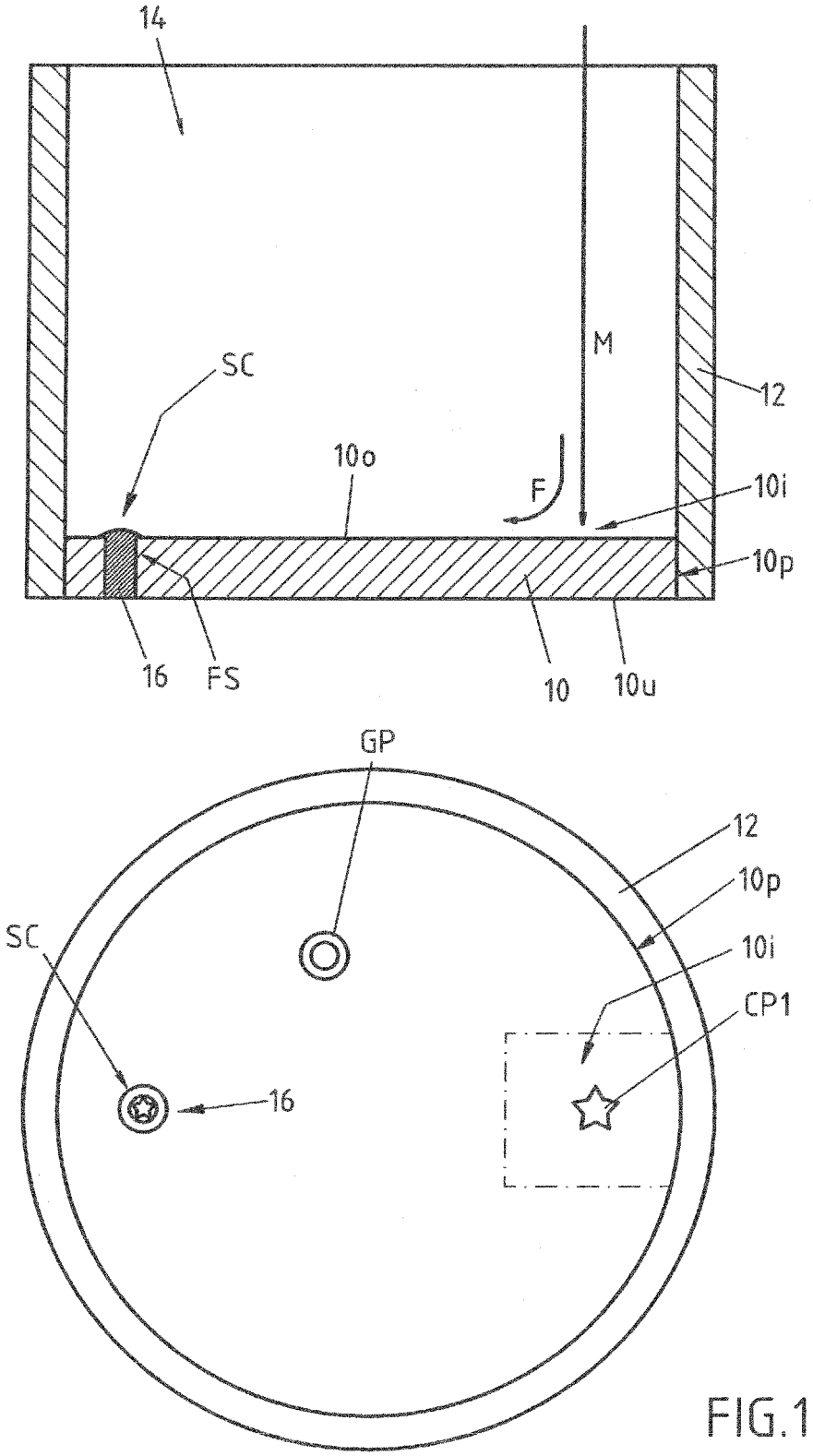
FIG.1 prior art

(52) U.S. Cl.
CPC ..... *F27D 1/0043* (2013.01); *F27D 3/1518* (2013.01); *F27D 3/1536* (2013.01); *C21C 7/0075* (2013.01)

(58) Field of Classification Search
CPC ..... B22F 9/16; B01J 19/0093; B01J 2219/00795; B01J 2219/0086; B01J 2219/00869; B01J 2219/00873; B01J 2219/00882; B01J 2219/00889; B01J 2219/009; B01J 2219/00934; B01J 2219/00941; B01J 2219/00957; B01J 2219/0097; B22D 41/08; C01B 19/002; C01G 21/21; C01P 2004/03; C21C 7/0075; F27B 14/08; F27D 1/0006; F27D 1/0043; F27D 3/1518; F27D 3/1536
USPC ..... 266/236, 275; 222/590, 591; 164/335, 164/437, 488, 337
See application file for complete search history.

(56) References Cited

U.S. PATENT DOCUMENTS 5,188,796 A * 2/1993 Soofi ..... B22D 41/003 222/594
5,348,275 A * 9/1994 Soofi ..... B22D 41/50 222/591
5,518,153 A * 5/1996 Zacharias ..... B22D 41/003 222/594
2016/0167126 A1* 6/2016 Kohler ..... B22D 41/08 266/236

* cited by examiner

LADLE BOTTOM AND LADLE

The invention relates to a ladle bottom being part of a metallurgical ladle for treating a metal melt as well as a corresponding metallurgical ladle.

Such a ladle bottom is made of a refractory ceramic body providing an upper surface, a lower surface and a pouring channel extending between upper surface and lower surface. As part of the ladle the ladle bottom is fitted within one end of a corresponding wall portion, wherein the wall extends from the outer periphery of the ladle bottom.

Ladle and ladle bottom each are described hereinafter in a position when the ladle bottom is arranged horizontally and at the lower end of the ladle.

A metal melt is poured (cast) into the ladle via an open upper end of the ladle. The metal stream first hits the ladle bottom, before being redirected to flow along the upper surface of the ladle bottom and towards the pouring channel, which is closed at this stage of the casting process by a filler sand to avoid uncontrolled outflow of the metal melt. During this stage of the casting process several problems arise, inter alia:

- A considerable wear of refractory material along the impact area when the metal stream hits the refractory material.
- The filler sand, in particular any filler material protruding the upper surface of the ladle bottom, is flushed away in an uncontrollable manner by the melt stream, thus causing irregularities and/or defects in the following casting sequence.

To solve the wear problem numerous proposals have been made. To reduce such wear it is known to use refractory materials for said impact area which are less prone to wear and/or to provide a discrete, so-called impact pad which is arranged on top of the upper bottom surface.

The filler sand problem hasn't been solved yet.

The monolithic filler material further causes problems during gas treatment of the melt in the ladle. Typically such treatment gas is fed into the metal melt via so called gas purging plugs (German: Gasspulsteine), arranged in the bottom and/or wall portion of the ladle, causing turbulences within the melt volume. Filler sand again is accidentally flushed away by these turbulences before tapping starts.

This is true in particular during so-called "hard stirring", being defined by a gas volume of >40 $m^3/h$ (typically 40-70 $m^3/h$) for an industrial ladle comprising 100.000 to 300.000 kg metal melt. "Soft stirring" describes a gas treatment with gas volumes below said 40 $m^3/h$, in particular volumes of 10-30 $m^3/h$.

The problems caused by gas flushing haven't been solved either yet.

The invention therefore has the object to provide a technical solution to reduce or avoid uncontrolled sweeping off (flushing away) of such filler sand being arranged along and on top of the pouring channel, which extends from the upper surface of the ladle bottom towards its lower surface and adjacent installations like nozzles/sliding plates etc.

During intensive investigations, including water modelings and mathematical studies it has been found that various factors are responsible for the drawbacks mentioned, inter alia:

- the overall mass of the melt and the melt speed. In a typical metallurgical ladle comprising 150.000 to 250.000 kg steel melt the filling time is only about 4-6 minutes

- the most severe conditions are at the beginning of the casting process and during gas treatment of the melt in the ladle
- the overall size of the ladle bottom and the distance between impact area and pouring channel
- the way and direction of the melt on its way from the impact area to the pouring channel Considering these and other factors the invention proposes in its most general embodiment a ladle bottom comprising the following features:

- it is made of a refractory ceramic body with an upper surface, a lower surface and a pouring channel extending between upper surface and lower surface, wherein
- said pouring channel extends from a diffusor box, being defined by a deepened section of said upper surface, wherein the said diffusor box is characterized by the following features:
- it is arranged at a distance to a surface area of the ladle bottom used as an impact area for a metal melt poured onto said ladle bottom
- it is arranged at a distance to each gas purging element within the ladle bottom
- it has a step at least along its border facing the impact area, wherein said step has a vertical height of between 40 and 200 mm
- it has a minimum horizontal area $$A_{min} = \frac{\Pi}{4}(0.37r)^2 + 0.3$$

and a maximum horizontal area $$A_{max} = \frac{\Pi}{4}(0.8r)^2 + 0.3$$

wherein r=radius of the ladle bottom and r≥0.75 m with $r_{max}$=2 m for all ladle bottoms with an effective radius of ≥2 m, and Π=pi=3.14 (hereinafter called formulae I),

- an inlet end of said pouring channel is arranged offset the step along its border facing the impact area.

The main feature is the so-called diffusor-box, its dimensions and orientation with respect to the pouring channel, any gas purging elements, the impact area and the ladle bottom in total.

The term "diffusor box" implements its main task, namely to slow down the speed of the metal melt on its way to the pouring channel, which pouring channel is arranged within the said diffusor box, namely at a considerable distance to its border.

According to one embodiment the inlet end of the pouring channel is arranged within a surface section of the diffusor box which covers less than 90% of the overall surface area of the diffusor box with the proviso that the thus defined surface section is centered within the overall surface area. It is preferred to reduce this value to <80%, <70%, <60% or <50%.

The provision and design of the diffusor box is important to reduce the kinetic energy of the metal melt before the melt reaches the inlet end of the pouring channel and thus before the melt gets in contact with any filler material (filler sand) within and/or on top of the pouring channel. The provision and design of the diffusor box is as well important to reduce turbulences of the melt within the ladle during gas purging treatment.

The diffusor box is characterized by a recessed (deepened) section (area) of the upper surface of the ladle bottom, thus providing means to redirect the metal stream when flowing from the regular upper surface area into said recessed section.

The invention provides a step along that way the metal stream takes after hitting the impact area and before entering the pouring channel. The term "step" is defined as a geometrical discontinuity. Two right angles with the adjacent surface section of the diffusor box and the remaining, regular surface area of the ladle bottom respectively describe the ideal step, although slight variations (<+/−30 degrees, better <+/−20 degrees, even better <+/−10 degrees) may be accepted under technical conditions.

This step reduces the melt speed significantly. The (vertical) height of the step is set between 40 and 200 mm, wherein the upper limit may be set as well at 160 mm, 150 mm, 140 mm, 125 mm or even at 100 mm, while the minimum height may be set as well at 45 mm, 50 mm, 55 mm or 60 mm. A height of less than 40 mm does not influence the speed of the metal melt sufficiently to protect the filler sand in the pouring channel. A height of more than 200 mm contradicts the effect because of excessive splashing.

The diffusor box is arranged at a distance to the impact area to reduce the effect of splashing around the impact area and to provide a sufficient distance between impact area and pouring channel.

According to one embodiment the distance between a central point along the upper surface of the impact area and a central point along the upper surface of the diffusor box is about 30 to 75% of the maximum horizontal extension of the ladle bottom, with possible lower limits at 40, 45 or 50% and possible upper limits at 65 and 70%. With the minimum diameter of the ladle bottom being defined at 1.5 m good results are achieved with distances of 500 to 1200 mm. With the maximum diameter considered in the disclosed formula being set at 4 m, even in cases of a ladle bottom with an effective diameter of >4 m, good results are achieved with distances of >1500 mm for large ladle bottoms.

The "central point" of the impact area may be defined as that point which the central longitudinal axis of the metal stream flowing into the ladle hits. The central point of the diffusor box is the geometrical centre, which may fall into the area defined by the inlet end of the pouring channel.

The overall size (in $m^2$) of the diffusor box is defined by the two formulae (I) disclosed. The upper and lower limits recognize the influence of gas purging during a secondary metallurgical treatment of a melt in the ladle. These limits are decisive for the reduction of turbulences in the space defined by the diffusor box and especially next to its surface.

Typically the speed of the metal melt next to the bottom surface is up to 0.3 m/s. High speeds are due to "hard stirring", lower values may prevail during "soft stirring". Insofar $A_{max}$ is mainly influenced by "soft stirring" while $A_{min}$ defines the preferred size in case of "hard stirring".

In other words: The melt is typically gas treated in the ladle by "soft stirring" and "hard stirring" intervals. Insofar the overall size of the diffusor box is defined by both.

In cases when "hard stirring" dominates the overall size of the surface area of the diffusor box should be $<(A_{min}+A_{max})/2$, best as close as possible to $A_{min}$ while it should be $>(A_{min}+A_{max})/2$ in case of "soft stirring" prevails and then as close as possible to $A_{max}$. A surface area of exactly $(A_{min}+A_{max})/2$ is a compromise between the two alternatives. Similar results may be achieved with an overall surface area of the diffusor box in the range of +/−10% or +/−20% of $(A_{min}+A_{max})/2$.

In case of "hard stirring" it is further preferred to provide a diffusor box with a height of the step at the upper end of the disclosed range, especially >80 mm or >100 mm.

In all embodiments filler sand is flushed off much less during gas purging compared with conventional designs of ladle bottoms as mentioned above.

To reduce accidental wear of filler material It is further advantageous to keep a minimum distance between any gas purging element and the pouring channel. Preferably there are no gas flushing/purging elements in the diffusor box area and the minimum distance is defined correspondingly to the minimum distance between impact spot and pouring channel.

The following table quotes useful upper and lower values of the horizontal diffusor area [in $m^2$]:

| example | ladle bottom diameter in m | $A_{min}$ in $m^2$ | $A_{max}$ in $m^2$ |
|---|---|---|---|
| A | 1.5 | 0.361 | 0.583 |
| B | 2.5 | 0.468 | 1.085 |
| C | 3.5 | 0.629 | 1.839 |

The absolute upper value ($A_{max}$) may be set at 2.3 $m^2$, 2.2 $m^2$, 2.1 $m^2$ or 2.0 $m^2$. The overall size ($A_{min}$) of the diffusor box is important as well to allow the metal melt to distribute over the diffusor area and thus to further slow down. $A_{max}$ is important to allow a sufficient (minimum) distance between impact area (and/or gas purging element) and pouring channel.

Finally the position of the pouring channel within the diffusor box influences the required effect. As may be derived from the above disclosure a position close to the border (step) or in direct contact with an adjacent ladle wall section would contravene the effect described. Insofar it is recommended to arrange the pouring channel offset said border and offset the ladle wall.

According to one embodiment the pouring channel is arranged at a distance to the step, which runs along the border facing the impact area, said distance being equal to or larger 3 times the maximum horizontal extension of the pouring channel. In case of a cylindrical pouring channel the minimum distance corresponds 3 times its diameter, wherein the "horizontal extension" or "diameter" respectively is defined as the smallest value over its length. The minimum distance may be extended to a factor >5, >6, >7, >8 or >9.

In case of a pouring channel with a diameter of 40 mm the minimum distance between pouring channel and step is 120 mm but may reach 280 mm or more.

The invention includes a ladle comprising a bottom as mentioned above. Both (ladle and ladle bottom) are shown in the attached drawing.

The bottom may be varied according to one or more of the following optional features:

The step is most important along the way the metal melt takes between impact pad and diffusor box but may be extended to both sides horizontally. Insofar the step (bordering the diffusor box at least partially) may extend along at least 75% (or at least 80% or at least 95%) of the border of the diffusor box.

The step may be extended as well along the complete border of the diffusor box. This gives the diffusor box a tub-like design with respect to the remaining upper surface of the ladle bottom.

This includes a design wherein the diffusor box is arranged at the outer periphery of the ladle bottom. Part of its border in then defined by the corresponding ladle wall.

The invention includes embodiments wherein the diffusor box has one or more border sections continuously sloping into the adjacent regular upper surface area (comprising the impact area) of the ladle bottom. Such smooth transition region between diffusor box and adjacent parts of the ladle bottom may preferably arranged opposite the disclosed "step" and defined by angles between 60 and <90° to the horizontal.

The border(line) defining the outer geometry (shape) of the diffusor box may be arbitrary, for example rectangular, circular or oval. Regarding an rectangular shape the relation between length/width may be—for example—>1.5 or >2.0 or >2.5 or >3.0. The same relations apply with oval shapes wherein length and width are defined by the longest and shortest distance between opposing sections.

According to a further embodiment the horizontal area of the diffusor box corresponds to 3.7 to 32.9% of the total surface area of the ladle bottom. The minimum value may be set as well at 5.8% while the upper value may be equal or smaller than 25.5% of the total surface area of the ladle bottom.

The invention further provides an embodiment characterized by a dam like protrusion between impact area and diffusor box in order to further reduce the melt speed flowing along the bottom area from said impact area toward said diffusor box. This protrusion extends substantially perpendicular to a direction along which the corresponding metal melt will flow from the impact area into the diffusor box after hitting the impact area. In other words: The melt is temporarily stopped in front of the protrusion (barrier) and may only continue its flow after having passed the said obstacle.

Further features of the invention may be derived from the sub-claims and the other application documents.

The size of the diffusor box may be defined alternatively or as an additional condition to the formulae I by the following formulae II: The thus preferred area of the diffusor box is characterized by the intersection of formulae I and formulae II respectively.

$$A_{min}=x+10/161\cdot\ln[M]$$

$$A_{max}=5y+4/25\cdot\ln[M]$$

with x=0.16 to 0.20 and y=0.20 to 0.16

M=nominal mass of the metal melt in the associated ladle (in 1000 kg) and $A_{min}$ as well as $A_{max}$ in square meters ($m^2$), with possible limited ranges:

x=0.16 to 0.17 and y=0.20 to 0.19 x=0.16 to 0.18 and y=0.20 to 0.18.

The attached drawing schematically represents in

FIG. 1 a prior art ladle in a longitudinal sectional view and a top view

Figure 2:
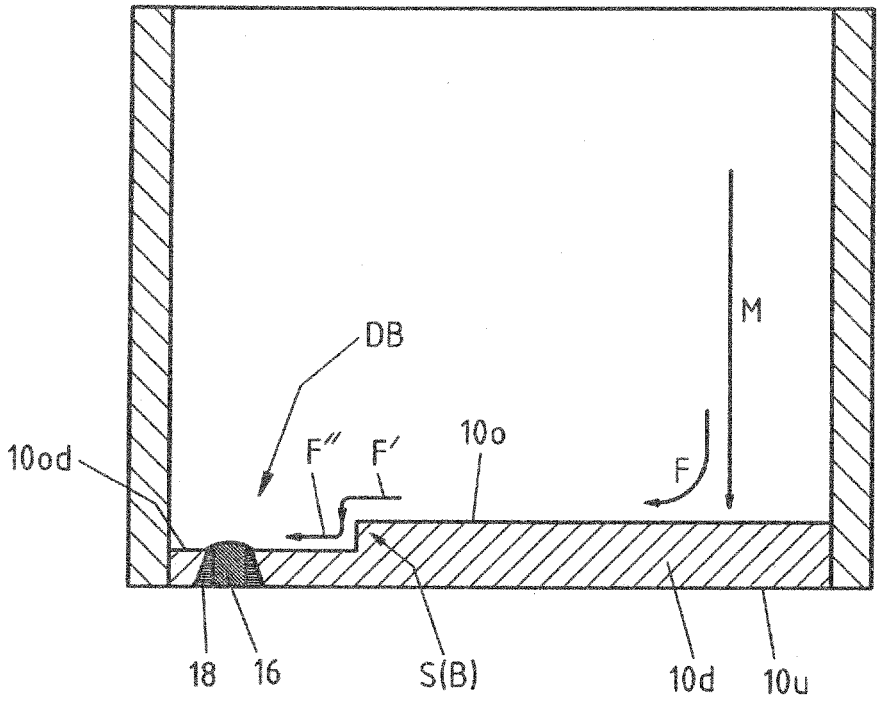
Figure 2:
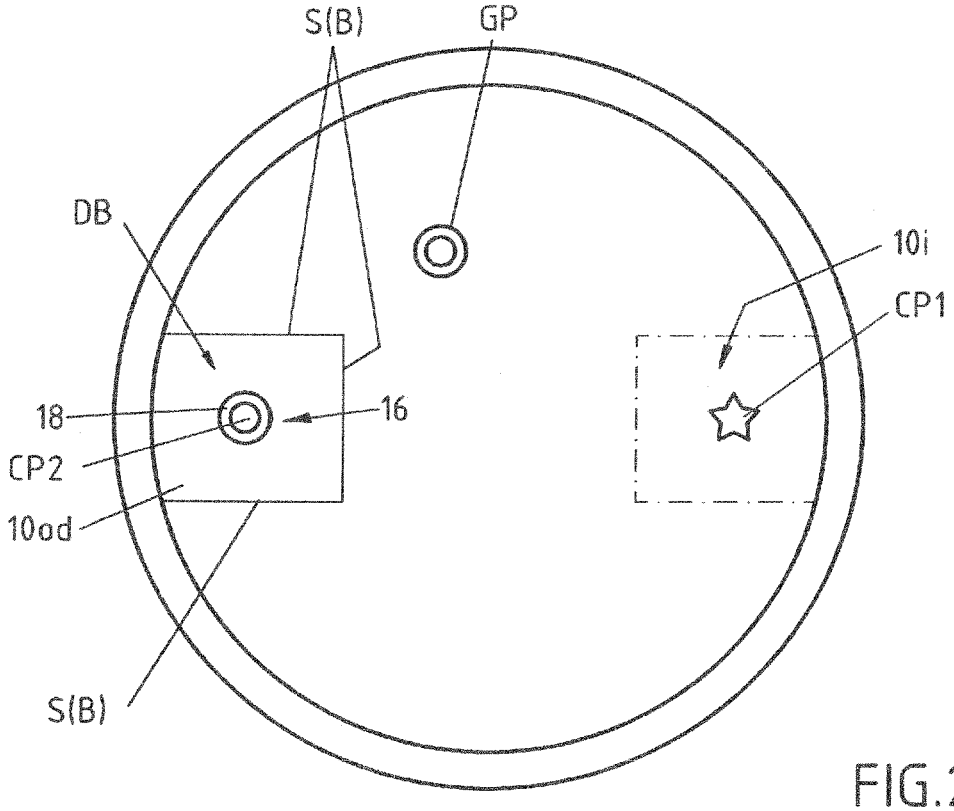
Figure 3:
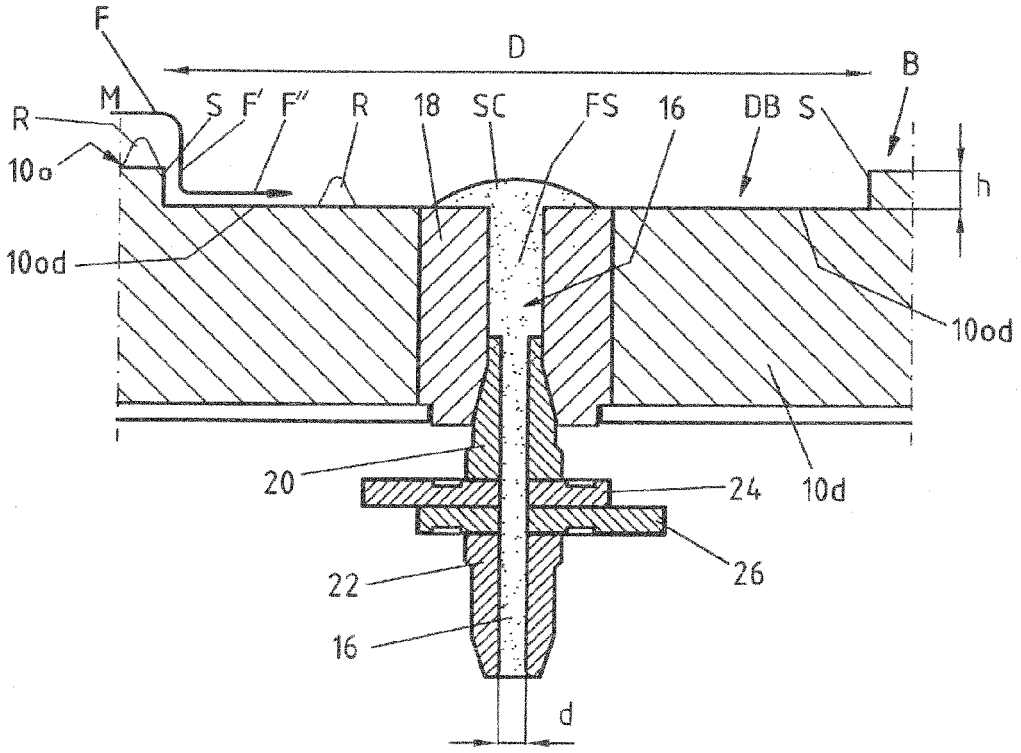

FIG. 2 a ladle according the invention in a longitudinal sectional view and a top view FIG. 3 an enlarged longitudinal section of the slightly different shape of a diffusor box with adjacent components The same numerals are used for parts providing the same or at least similar features.

The ladle of FIG. 1 has a circular, horizontally extending bottom 10 with an upper horizontal surface 10*o* and a lower horizontal surface 10*u*. A substantially cylindrical ladle wall 12 extends upwardly from the outer periphery 10*p* of ladle bottom 10. An open upper end of the ladle is symbolized by numeral 14.

A metal stream MS is shown by arrow M, entering the ladle by its open end 14, flowing vertically downwardly before hitting an impact area 10*i* of the upper surface 10*u* of ladle bottom 10.

At least part of the metal stream continues its flow (arrow F) towards a pouring channel 16 arranged offset to said impact area 10*i*, which pouring channel 16 runs from upper surface 10*u* to lower surface 10*o*.

As shown in FIG. 1 the said pouring channel 16 is filled with a so called filling sand FS and a sand cone SC may be seen on top of channel 16. The filler material keeps the metal melt off the channel during filling the ladle. It serves to avoid unintended tapping when the ladle is filled. Insofar it has an important function within the casting process.

In a prior ladle according to FIG. 1 the sand SC may be flushed away by the melt stream (arrow F), causing serious uncertainties and risks in the following casting process. This filler material is further at least partially flushed away in case of a gas treatment of the melt by gas purging plugs, one of which is shown and represented by GP.

The new ladle design according to FIG. 2, 3 provides a diffusor box DB around said pouring channel 16 and offset (at a distance to said) impact area 10*i*.

The diffusor box DB is characterized by a recess within upper surface 10*o*, i.e. a section deepened with respect to the adjacent areas of upper surface 10*o* and thus providing a step S along the border (borderline) B of said diffusor box DB. The upper surface section of diffusor box DB is referred to as 10*od*. The vertical part of said step S forms a right angle with respect to both adjacent sections of the upper bottom surface 10*o*/10*od*.

The diffusor box DB has a mainly rectangular upper surface 10*od*. A well nozzle 18 (German: Lochstein) is arranged in the bottom portion 10*d* of the diffusor box DB.

The central through opening of said well nozzle 18 defines an upper part of pouring channel 16.

An inner nozzle 20—known per se—is arranged within the lower part of said well nozzle 18, followed in a conventional way by a sliding gate with sliding plates 24, 26 and an outer nozzle 22, defining the middle and lower part of the pouring channel 16.

The pouring channel 16 is filled with filler sand FS, including a sand cone SC on top of well nozzle 18—similar to FIG. 1—.

The dimensions of said diffusor box DB are as follows:

height h of step S: 100 mm length: 1370 mm, width: 1085 mm diameter of pouring channel 16 along nozzles 20,22: 80 mm distance between a central point CP1 of the impact area 10*i* (along the upper surface 10*u*) and a central point CP2 along the upper surface of the diffusor box DB: 2200 mm.

inner diameter of the ladle bottom 10: 3530 mm

The melt stream M hits the impact area 10*i* (with CP1 being the central hitting point) in a conventional way but its speed is then slowed down on its way to pouring channel 16 by said diffusor box DB and especially by said step S, which at the same time redirects the melt stream M twice (FIG. 3: F, F', F").

By this means the filler material FS is protected from being flushed away until the ladle is filled more or less completely and the pouring channel 16 opened in a conventional way.

The filler material remains more or less intact and at its place even in case of a (conventional) gas treatment of the melt as the then rotating melt "overflows" said area of said diffusor box to a considerable extent with a considerably reduced speed. One of several gas purging plugs, installed in ladle bottom 10 is shown as GP. The distance between its central longitudinal axis and CP2 is 1020 mm.

FIG. 3 shows a diffusor box DB arranged offset ladle wall 12, i.e. with a circumferentially extending borderline B and step S. It further includes an optional feature of a barrier shaped as a rib R in front of said step S and/or in front of the pouring channel 16 (seen in the flow direction F of the metal melt MS) to further reduce the melt speed. Insofar the said barrier is arranged across (perpendicular to) to a straight line between CP1 and CP2 being the direction of the melt on its way from impact area 10*i* to pouring channel 16, symbolized by arrows F, F', F". This barrier may be replaced by one or more protruding shapes, including: undulated surface sections, dams, prism or the like.

The invention claimed is:

1. Ladle bottom made of a refractory ceramic body with an upper surface, a lower surface and a pouring channel extending between upper surface and lower surface, wherein said pouring channel extends from a diffusor box, being defined by a deepened section of said upper surface, wherein the diffusor box is characterized by the following features:

a) it is arranged at a horizontal distance to a surface area of the ladle bottom used as an impact area for a metal melt poured onto said ladle bottom, b) it has a vertical step at least along its border facing the impact area, wherein said step has a height of between 40 and 200 mm, c) it has a minimum horizontal area $$A_{min} = \frac{\Pi}{4}(0.37r)^2 + 0.3$$

and a maximum horizontal area $$A_{max} = \frac{\Pi}{4}(0.08r)^2 + 0.3$$

wherein r=radius of the ladle bottom and r≥0.75 m with $r_{max}$=2 m for all ladle bottoms with an effective radius of ≥2 m, d) an inlet end of said pouring channel is arranged offset the step along its border facing the impact area.

2. Ladle bottom according to claim 1, wherein the step extends along at least 75% of the border of the diffusor box.

3. Ladle bottom according to claim 1, wherein the step extends along the complete border of the diffusor box.

4. Ladle bottom according of claim 1, wherein the border defining the outer geometry of the diffusor box has a rectangular, circular or oval shape.

5. Ladle bottom according to claim 1 wherein the horizontal area of the diffusor box corresponds to 3.7 to 32.9% of the total surface area of the ladle bottom.

6. Ladle bottom according to claim 5 wherein the horizontal area of the diffusor box is equal or larger than 5.8% of the total surface area of the ladle bottom.

7. Ladle bottom according to claim 5 wherein the horizontal area of the diffusor box is equal or smaller than 25.5% of the total surface area of the ladle bottom.

8. Ladle bottom according to claim 1 wherein the pouring channel is arranged at a distance to the step along its border facing the impact area being equal or larger 3 times its maximum horizontal extension.

9. Ladle bottom according to claim 1 with a distance between a central point along the upper surface of the impact area and a central point along the upper surface of the diffusor box being 30 to 75% of the maximum horizontal extension of the ladle bottom.

10. Ladle bottom according to claim 1 with a distance between a central point along the upper surface of the impact area and a central point along the upper surface of the diffusor box being 50 to 65% of the maximum horizontal extension of the ladle bottom.

11. Ladle bottom according to claim 1 with a distance between a central longitudinal axis of a gas purging plug arranged in the ladle bottom and a central point along the upper surface of the diffusor box being 30 to 75% of the maximum horizontal extension of the ladle bottom.

12. Ladle bottom according to claim 1 with a distance between a central longitudinal axis of a gas purging plug arranged in the ladle bottom and a central point along the upper surface of the diffusor box being 50 to 65% of the maximum horizontal extension of the ladle bottom.

13. Ladle bottom according to claim 1 with a dam like protrusion between impact area and diffusor box, extending substantially perpendicular to a direction along which a corresponding metal melt will flow from the impact area into the diffusor box after hitting the impact area.

* * * * *